US006322287B1

(12) United States Patent
Yelton

(10) Patent No.: US 6,322,287 B1
(45) Date of Patent: Nov. 27, 2001

(54) AGGREGATE GRADING MACHINE

(76) Inventor: James E. Yelton, 90294 Prairie Rd., Eugene, OR (US) 97402

( * ) Notice: Subject to any disclaimer, the term of this patent is extended or adjusted under 35 U.S.C. 154(b) by 0 days.

(21) Appl. No.: 09/546,698

(22) Filed: Apr. 10, 2000

(51) Int. Cl.[7] ..... E01C 19/00

(52) U.S. Cl. ..... 404/118; 404/92; 404/98; 404/102

(58) Field of Search ..... 404/84.05, 84.1, 404/84.2, 84.5, 84.8, 85, 86, 92, 96, 98, 101, 102, 104, 113, 114, 118, 119

(56) References Cited

U.S. PATENT DOCUMENTS

| | | | | |
|---|---|---|---|---|
| 2,951,427 | | 9/1960 | Moir . | |
| 3,396,642 | | 8/1968 | Martinson . | |
| 3,602,115 | * | 8/1971 | Hanson | 404/118 X |
| 3,841,777 | | 10/1974 | Domenighetti . | |
| 3,999,314 | * | 12/1976 | Miller et al. | 172/4 X |
| 4,395,156 | * | 7/1983 | Sprague, III | 404/110 |
| 4,496,265 | | 1/1985 | Fragale . | |
| 5,156,487 | * | 10/1992 | Haid | 404/119 X |
| 5,344,254 | * | 9/1994 | Sartain | 404/118 X |
| 5,348,418 | * | 9/1994 | Campbell | 404/118 X |
| 5,638,656 | * | 6/1997 | Roe | 52/749.1 |

OTHER PUBLICATIONS

"Do It All", Ingersoll–Rand Brochure, 1995.*

* cited by examiner

*Primary Examiner*—William Neuder
*Assistant Examiner*—Sunil Singh
(74) *Attorney, Agent, or Firm*—James D. Givnan, Jr.

(57) ABSTRACT

A grading machine includes a forwardly projecting frame partially supported by a small tractor. A blade assembly on the frame disperses and strikes off aggregate for subsequent paving along a course. The blade assembly of the apparatus is indirectly supported by linear actuators in turn supported by a shoe which travels along the aggregate surface. Adjustable indicators on the flame indicate the relationship of the aggregate surface to a desired aggregate height with subsequent operation of the actuators lifting or lowering the blade assembly to raise or lower the blade assembly strike off action for return of the indicators to a predetermined relationship to guides, shown as concrete forms, extending along the course of the aggregate being laid. A vibratory compactor trails the shoe and may move about multiple axes. The shoe supported actuators may be operated in a uniform or differential manner, the latter resulting in transversely tilting the blade assembly for transverse sloping of the aggregate surface. Powered arms on the tractor may lift and lower the grading apparatus for transport to and from work sites.

15 Claims, 3 Drawing Sheets

AGGREGATE GRADING MACHINE

BACKGROUND OF THE INVENTION

The present invention concerns equipment used for the grading of crushed rock or other aggregate preparatory to a paving operation.

In the construction of paved surfaces it is common practice to use a machine having a screed component for determining the thickness of aggregate of the sidewalk or roadway under construction. In the construction of sidewalks it is not feasible to utilize construction equipment intended for roadway construction. Instead it is current practice to employ a number of workers to rake or spread and configure aggregate prior to paving. Such a practice is costly from a man hour standpoint Secondly, non-uniform aggregate thickness often results from such effort As sidewalk specifications dictate aggregate thickness within a fairly narrow range, it is often necessary to re-accomplish at least partial spreading of the aggregate to meet specified depth. A further drawback to working aggregate manually is the quality of the aggregate is degraded in that working of deposited aggregate results in the smaller particles or fines thereof gravitating toward lowermost area of aggregate with the result that the top layer is largely devoid of fines or small particles. Desirably, aggregate is of uniform constituency throughout its depth with one object being that the concrete or other material when laid does not gravitate down through the aggregate but rather tends to lie for the most part on the uppermost surfaces of the aggregate to reduce the quantity of paving material used in the opeation without a reduction in the integrity of the finished paving.

U.S. Pat. No. 4,496,265 shows a self-propelled asphalt paving machine which is wheel supported with a laterally tiltable screed and requiring two operators if paving thickness is monitored.

U.S. Pat. No. 3,841,777 is of interest in that it includes a vibratory compactor, on a road surfacing machine with strain sensitive suspension to indicate the density of paving material and control the strike off height of a "skimmer" or screed to effect uniform density of "surfacing material".

U.S. Pat. Nos. 3,396,642 and 2,951,427 show grading machines with trailed vibratory compactors.

SUMMARY OF THE PRESENT INVENTION

The present invention concerns equipment used for the grading of crushed rock or other aggregate preparatory to a paving operation.

The apparatus includes a highly maneuverable prime mover, preferably a tractor of the skid-steer type desirably having a tread dimension enabling travel between forms for sidewalk construction. A forwardly extending frame of the apparatus is mounted on the tractor and carries a blade or strike off at its forward end. A movably mounted shoe of plate configuration trails from the frame and rides upon the aggregate surface with adjustable actuators positioning the shoe including any transverse inclination or slope of the aggregate. The actuating means additionally serves indirectly to lift and lower the strike off edge of the blade to determine the depth of aggregate. Indicators for aggregate depth are provided to permit an operator to continually monitor the depth of aggregate being laid. Control means provided the operator permits convenient, simultaneous or individual actuator extension or retraction while under way to achieve specified aggregate depth. A vibratory compactor trails the plate shaped shoe by means of pivotal linkages to compact horizontal or inclined aggregate surfaces. The prime mover is preferably of the type including hydraulically actuated lift arms for imparting elevation to the apparatus for travel to and from a grading site.

Important objectives of the present invention include the provision of a machine suited particularly for the grading of sidewalk aggregate, but not restrictively so, heretofore done by costly manual labor with wide variances in aggregate depth often encountered; the provision of a machine for grading aggregate in one pass to preserve the homogenous nature of aggregate otherwise reduced by repeated working of the aggregate resulting in the aggregate fines gravitating to the bottom, leaving the uppermost layer of aggregate more porous than desired; the provision of a machine for effecting the desired depth of aggregate while maintaining its homogenous nature to effect a savings in the amount of concrete used in a paving operation; the provision of an aggregate grading machine enabling the single machine operator to continuously monitor and adjust aggregate depth during travel along a course; the provision of a grading machine readily transportable on a medium sized flat bed truck to a job site.

DETAILED DESCRIPTION OF THE PREFERRED EMBODIMENTS

Figures 1, 4, 5, 6:
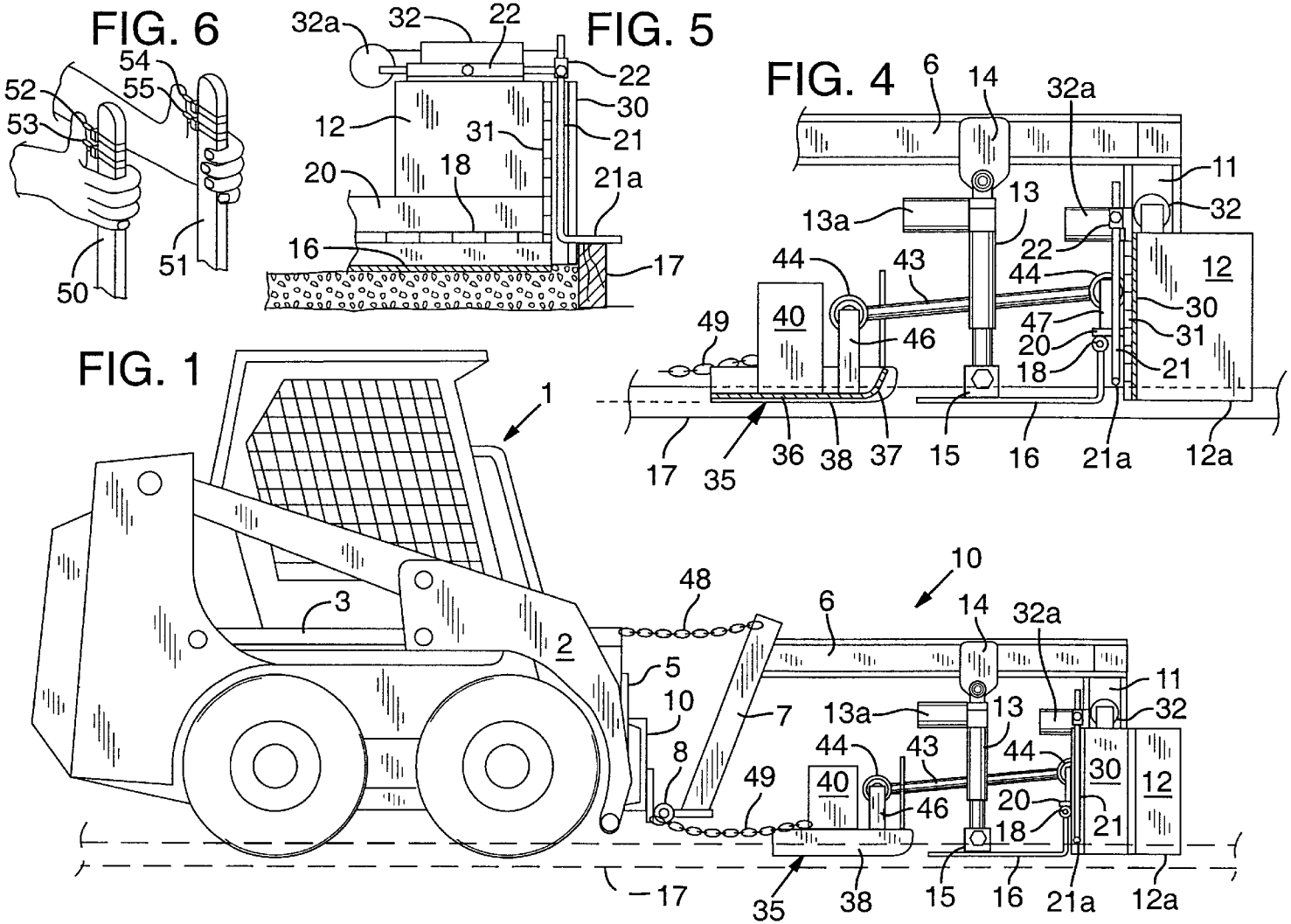
FIG. 1 is a side elevational view of a grading machine comprising atractor and grading apparatus.
FIG. 4 is a vertical sectional view along line 4—4 of FIG. 2.
FIG. 5 is a elevational view taken along line 5—5 of FIG. 3.
FIG. 6 is a fragmentary view of tractor steering arms and actuator switches thereon.

With continuing attention to the drawings wherein applied reference numerals indicate parts similarly hereinafter identified, the reference numeral 1 indicates generally a small tractor preferably of the skid-steer type including powered transmission front and rear sets of wheels steered by braking right side or left side wheels. A pair of arms 2 are powered by hydraulic cylinders 3 of the vehicle. Arms 2 are interconnected at their outer ends by a cross member 4. A quick change plate 5 is readily detachable from the arm ends to permit a wide range of machine use for other than present purposes.

Figure 2:
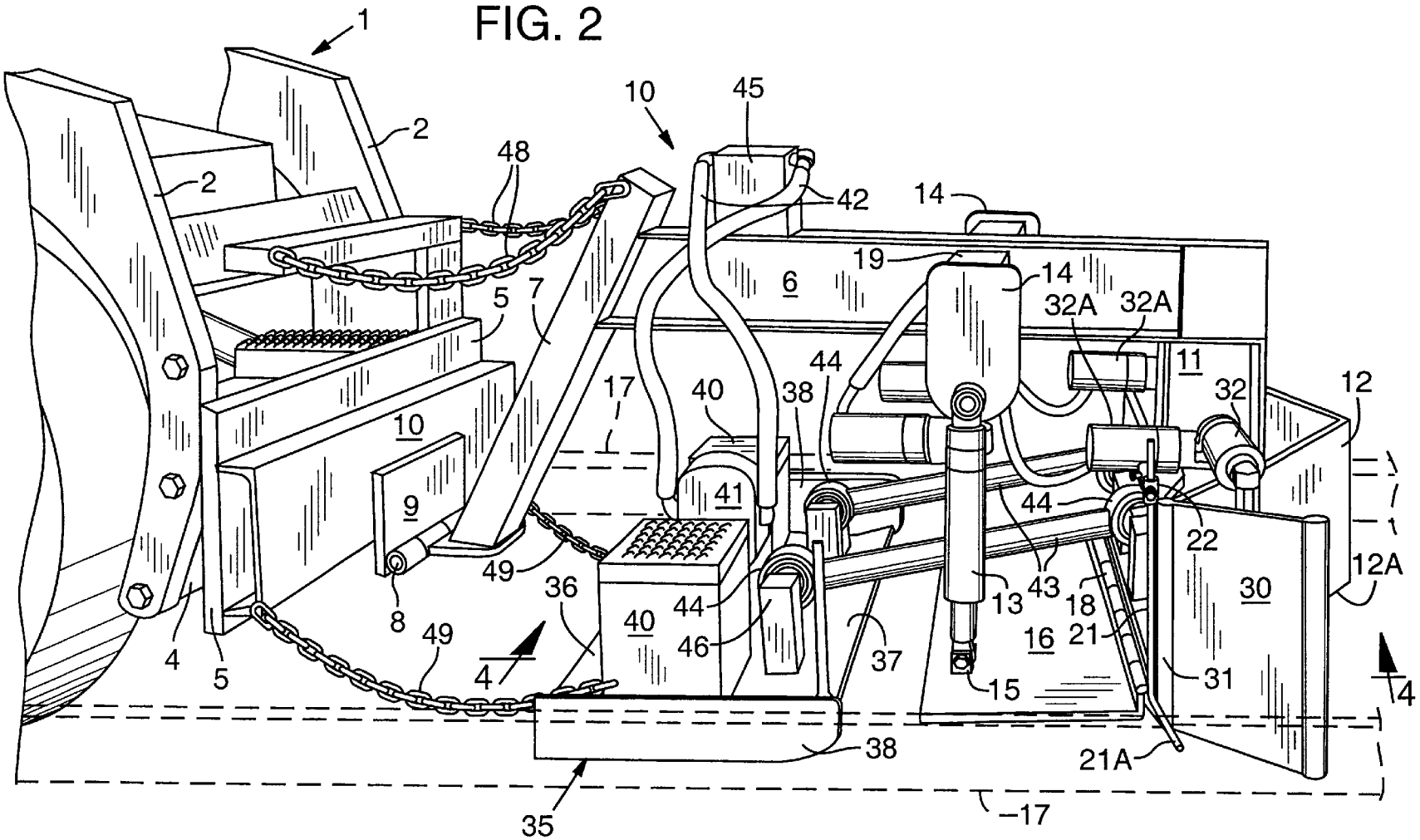
FIG. 2 is a side view of the grading apparatus with part of the tractor shown.
Figure 3:
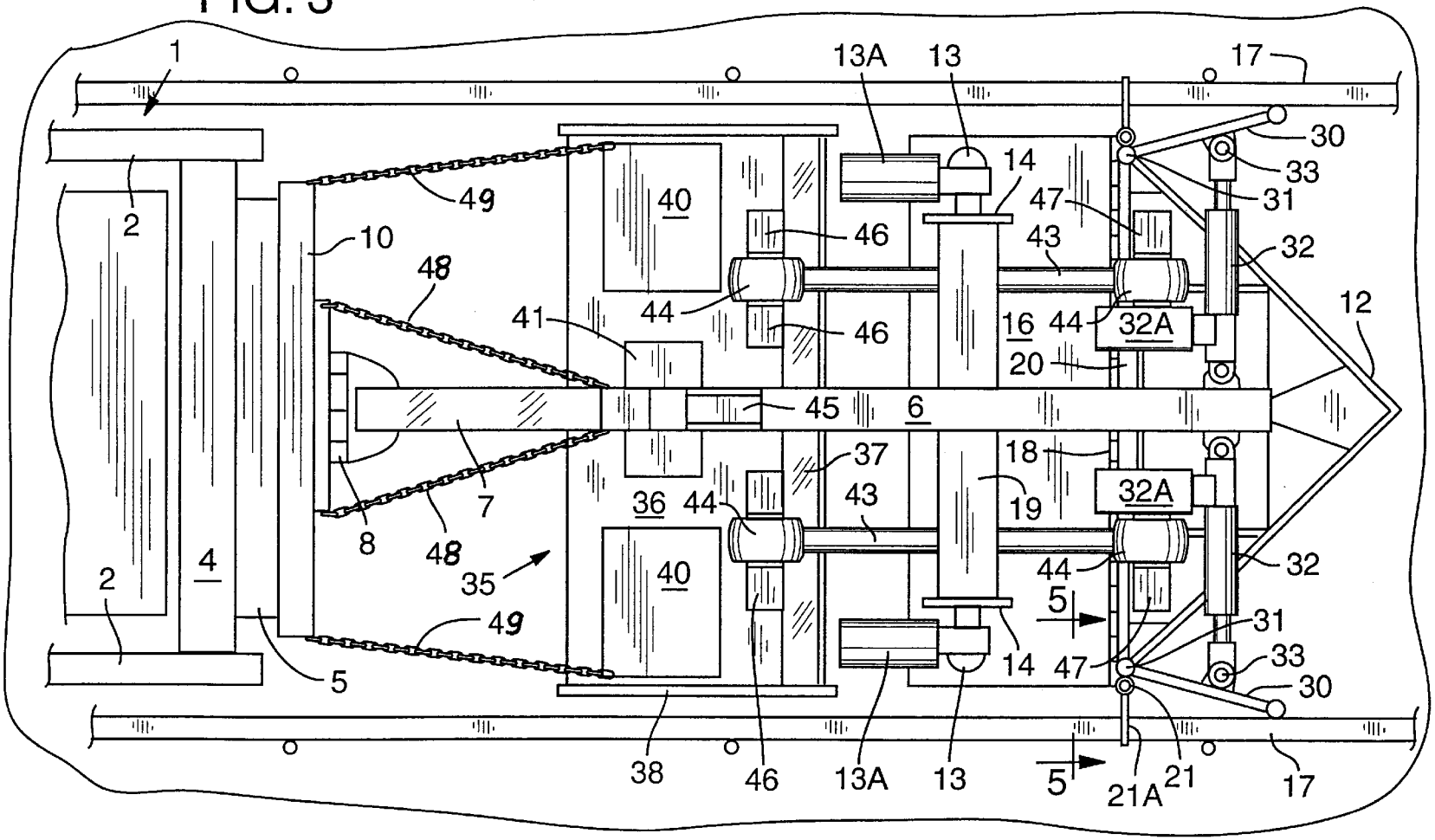
FIG. 3 is a plan view of FIG. 2.

A grading apparatus generally at 10 in FIG. 2 projects forwardly from tractor 1 and has a frame member 6 with a post 7 hingedly mounted at 8 to a hinge plate 9 in turn attached to a mounting plate 10 in place on tractor quick change plate 5. An I-beam 11 depends from the forward end of frame member 6 and carries a blade or strike off assembly having a bottom edge 12A (FIG. 1).

During a grading operation the forward portion of apparatus 10 is supported by linear actuators 13 each coupled to a laterally extending bracket 14 on the frame. The lower end of each actuator is coupled at 15 to a transversely disposed elongate shoe 16 shown as being of plate configuration and terminating at its ends adjacent paving forms at 17 defining an area, such as a sidewalk, to be paved. Shoe 16 is hingedly mounted at 18 to an angular cross member 20 of frame 6.

Accordingly, extension or retraction of the pair of linear actuators 13 will impart upward or downward movement to the machine frame 6 about hinge 8 and ultimately to blade assembly 12 to vary the strike off height of the aggregate earlier deposited between the forms. Preferably each linear actuator is electrically powered with a motor 13A in an electrical circuit, including a three way switch (later described) with a source of electrical energy provided by the prime mover.

Within view of the tractor operator are aggregate depth indicators at 21 each having a right angular segment 21A for travel subjacent the upper edge of a form 17. In a grading operation the blade 12, and specifically the lower edge 12A thereof, is positioned by linear actuators 13 at a distance above a ground surface intermediate forms 17 equal to the desired depth of aggregate desired. Upon such positioning the depth indicators 21 are then vertically adjusted to locate yieldable end segments 21A proximate the top edge of the forms as above noted. Adjustable support means at 22 (FIG. 5) permit both lateral and vertical positioning of the indicators 21.

Differential extension of the actuators 13 imparts crosswise or lateral tipping of frame 6 for an inclined aggregate surface by reason of the blade assembly being transversely inclined. In the paving of sidewalks it is not uncommon to incur a requirement that a transverse slope or incline be provided on the finished sidewalk surface for drainage purposes. In such an instance the blade 12 is so positioned about its fore and aft axis at the start of an aggregate working operation and the indicators on opposite sides of the blade vertically adjusted for subsequent travel along or adjacent the top surface of each form 17. During subsequent travel of the machine undesired departure of an angular indicator end segment 21A from its desired position adjacent the form top edge, will require the machine operator to actuate the appropriate linear actuator to lift or lower the respective blade portion, i.e., left or right to increase or reduce the depth of aggregate.

To accommodate working of surfaces of various transverse dimensions, wings as at 30 are pivotally mounted to the opposite ends of blade 12 by hinge structure 31 permitting wing positioning by actuation of a second set of linear actuators as at 32 with each actuator having a motor 32A. Typically the actuators 32 would be set for a fixed distance between the forms 17 at the start of a grading operation.

A compactor is indicated generally at 35 in FIG. 2 and includes a skid-like platform including a compactor plate 36 upwardly inclined at its forward edge 37 with the plate extending substantially the distance intermediate forms 17 with provision made for upright end plates 38 at the ends of plate 36. Weights at 40 are carried on plate 36 as is a vibrator 41 powered by a hydraulic fluid flow through conduits 42 and a flow divider 45. Links at 43 couple compactor plate 36 with brackets 47 in place on angle iron 20 of the frame. Each link includes end mounted trunnions 44 which permit plate 36 to compact aggregate whether the aggregate surface is level or transversely inclined. Supports at 46 attach the rearward trunnions of the links 43 to plate 36. The links and trunnions 44 may be of the type used as truck suspension components.

Enabling convenient travel to job sites is the compact nature of the present grading machine allowing transport on a medium sized flat bed truck. During loading and unloading of the machine the grading apparatus 10 is lifted from a ground surface by raising of tractor arms 2. Restraints, shown as chain lengths 48, become taut during such lifting to support the grader in substantially a raised, horizontal position while restraints at 49 inhibit sway of the apparatus when elevated.

In FIG. 6, tractor steering arms are shown at 50, 51. Finger actuated switches at 52, 53 on steering arm 50 are in circuit respectively with right side located linear actuator motors 13A–32A while steering arm 51 carries like switches 54, 55 in circuit with left side actuator motors 13A–32A to permit operation of the apparatus actuators without release of either control arm.

It will be understood that while electromechanical actuators are disclosed, in some instances, as for example, when a different size tractor is used, the actuators may be of the hydraulic type.

While I have shown but one embodiment of the invention, it will be apparent to those skilled in the art that the invention may be embodied still otherwise without departing from the spirit and scope of the claimed invention.

Having thus described the invention, what is desired to be secured by a Letters Patent is:

I claim:

1. A machine for grading aggregate along a course on a ground surface, said machine comprising, a prime mover, a frame carried by the prime mover and projecting forwardly therefrom in the direction of travel, blade assembly means on said frame for dispersing aggregate across the course providing an aggregate layer of selected depth, a shoe yieldably mounted on the frame for travel along the surface of the dispersed aggregate layer, actuator means coupling said shoe to the frame, control means activated by an operator of the prime mover to simultaneously vary the vertical distance between said shoe and the frame and the vertical distance between the frame carried blade assembly means and the ground surface to vary the depth of the aggregate layer, and indicator means on the frame for travel along the course in proximity to a fixed height reference with the vertical relationship of the indicator means to the fixed height reference being indicative of the depth of the aggregate layer relative the desired depth of aggregate.

2. The machine claimed in claim 1 wherein said prime mover includes powered lift arms, means coupling said lift arms to said frame for transport of the frame in an elevated manner to a job site.

3. The machine claimed in claim 2 additionally including pivot means adjacent the interface of the prime mover and said frame and about which the frame may be lifted by said lift arms.

4. The machine claimed in claim 1 wherein the shoe and the actuator means at least partially support the frame and blade assembly during grading of aggregate.

5. The machine claimed in claim 4 additionally including a compactor, links coupling the compactor to the frame.

6. The machine claimed in claim 5 wherein said links include bearings permitting displacement of the compactor about multiple axes.

7. The machine claimed in claim 1 wherein said indicator means includes an angular end segment for travel along the fixed height reference.

8. The machine claimed in claim 7 wherein said indicator means additionally includes rod members, means coupling said rod members for axial positioning of at least one rod member to locate the angular end segment proximate the fixed height reference prior to a grading operation.

9. The machine claimed in claim 1 wherein said shoe is of plate configuration, said actuator means including multiple actuators each oppositely offset from the machine center line.

10. The machine claimed in claim 9 wherein said control means includes individual controls on the prime mover for each of said actuators to permit positioning of the blade assembly about an axis substantially parallel to the course of machine travel.

11. A grading apparatus for loose aggregate for attachment to the forward end of a prime mover, said apparatus comprising, a frame, means for attaching the frame to the forward end of the prime mover driven by an operator for forward travel along a course, a blade assembly on the frame for striking off and dispersing aggregate along the course in a layer of desired depth, a shoe located traversely below said frame for travel along the surface of the layer of aggregate, linear actuated means connected to said shoe and to said frame and at least partially supporting the frame, control means for extension and retraction of said linear actuator means to vary the vertical distance between the shoe and the frame and between the blade assembly and a ground surface to vary the depth of the aggregate layer by blade assembly action, indicator means carried by said frame for travel proximate a fixed reference with the vertical spacing of the indicator means to the fixed reference indicative of aggregate depth, and a compactor, links coupling the compactor to said frame.

12. The grading apparatus claimed in claim 11 wherein said links include bearings permitting displacement of the compactor about multiple axes.

13. The grading apparatus claimed in claim 11 wherein said shoe is of plate configuration, said linear actuator means including multiple actuators each oppositely offset from the apparatus center line.

14. The grading apparatus claimed in claim 13 wherein said control means includes individual controls for each of said linear actuators for enabling inclined positioning of the frame mounted blade assembly in a plane transversely of the apparatus center line to incline the surface of the aggregate layer.

15. An apparatus for attachment to a prime mover for forward travel along a course for the grading of aggregate along the course, and along a fixed reference adjacent the course, said apparatus including, a frame having a forwardly mounted blade assembly for dispersing and striking off aggregate across the course, a shoe yieldably carried by the frame and transversely disposed below the frame aft of the blade assembly for substantially planar contact with the aggregate, adjustable means attached to the shoe and the frame for lifting or lowering the frame and attached blade assembly to vary the depth of the aggregate, indicator means on the frame for travel proximate the fixed reference and adjacent the course, a compactor, links coupling the compactor to said frame, said adjustable means operable to lift or lower the frame and the attached blade assembly carried thereby to position the indicator means at a desired vertical relationship from the fixed reference, and control means actuated by an operator of the apparatus to vary the vertical distance between the shoe and the frame and hence the vertical distance between the blade assembly and a ground surface to vary the depth of the aggregate layer.

* * * * *